US011376718B2

(12) United States Patent
Benz et al.

(10) Patent No.: US 11,376,718 B2
(45) Date of Patent: Jul. 5, 2022

(54) PACKING SCREW REMOVAL TOOL

(71) Applicant: Halliburton Energy Services, Inc., Houston, TX (US)

(72) Inventors: Kristopher A. Benz, Zanesville, OH (US); Brandon Stackhouse, Roseville, OH (US)

(73) Assignee: Halliburton Energy Services. Inc., Houston, TX (US)

( * ) Notice: Subject to any disclaimer, the term of this patent is extended or adjusted under 35 U.S.C. 154(b) by 127 days.

(21) Appl. No.: 16/840,243

(22) Filed: Apr. 3, 2020

(65) Prior Publication Data

US 2021/0308840 A1 Oct. 7, 2021

(51) Int. Cl.
*B25B 13/48* (2006.01)
*F04B 19/22* (2006.01)

(52) U.S. Cl.
CPC ..... *B25B 13/481* (2013.01); *F04B 19/22* (2013.01)

(58) Field of Classification Search
USPC ..... 81/52, 488; 269/45, 95, 3, 6; 29/255, 29/263, 278
See application file for complete search history.

(56) References Cited

U.S. PATENT DOCUMENTS 440,444 A * 11/1890 Stanton ..... B25B 27/0028 81/8.1
1,461,312 A * 7/1923 Hayward ..... B25B 27/023 29/259
1,578,174 A * 3/1926 Robinson ..... B25B 27/023 29/258
4,929,111 A * 5/1990 Lauritano ..... B25B 27/023 403/16

* cited by examiner

*Primary Examiner* — Orlando E Aviles
*Assistant Examiner* — Thomas Raymond Rodgers
(74) *Attorney, Agent, or Firm* — Conley Rose, P.C.; Rodney B. Carroll

(57) ABSTRACT

A packing screw removal tool for removing packing from a pump fluid end comprising: a tool body; a plurality of packing screw engagement dogs distributed about an axis of rotation about the packing screw removal tool; and a torque transfer engagement post coupled to the tool body. The engagement dogs align with and are releasably connected to radial locations on the packing screw. Applied torque is transferred through a torque transfer engagement post, through the tool body to the engagement dogs and into the packing nut. A second torque transfer engagement post is smaller than the first engagement post. The shape of the tool body allows rotation in limited or confined space. A pump may be serviced at the wellsite by utilizing the packing screw removal tool to unthread the packing screw from the fluid end.

9 Claims, 9 Drawing Sheets

PACKING SCREW REMOVAL TOOL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present disclosure relates generally to a method and apparatus for repairing equipment that supplies pressurized fluids. More particularly, the present disclosure relates to methods and devices for accessing seals on reciprocating devices for pumping fluids into a wellbore.

BACKGROUND

High-pressure pumps having reciprocating elements such as plungers or pistons are commonly employed in oil and gas production fields for operations such as drilling and well-servicing. For instance, one or more reciprocating pumps may be employed to pump fluids into a wellbore in conjunction with activities including fracturing, acidizing, remediation, cementing, and other stimulation or servicing activities. Due to the harsh conditions associated with such activities, seals and other pump components are susceptible to wear and may be replaced during servicing and maintenance of the pump. Access to the seals and other pump components is made by removing a packing screw from the fluid end. One or more seals may be replaced on location. Seals may be replaced during a scheduled maintenance at a servicing location.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
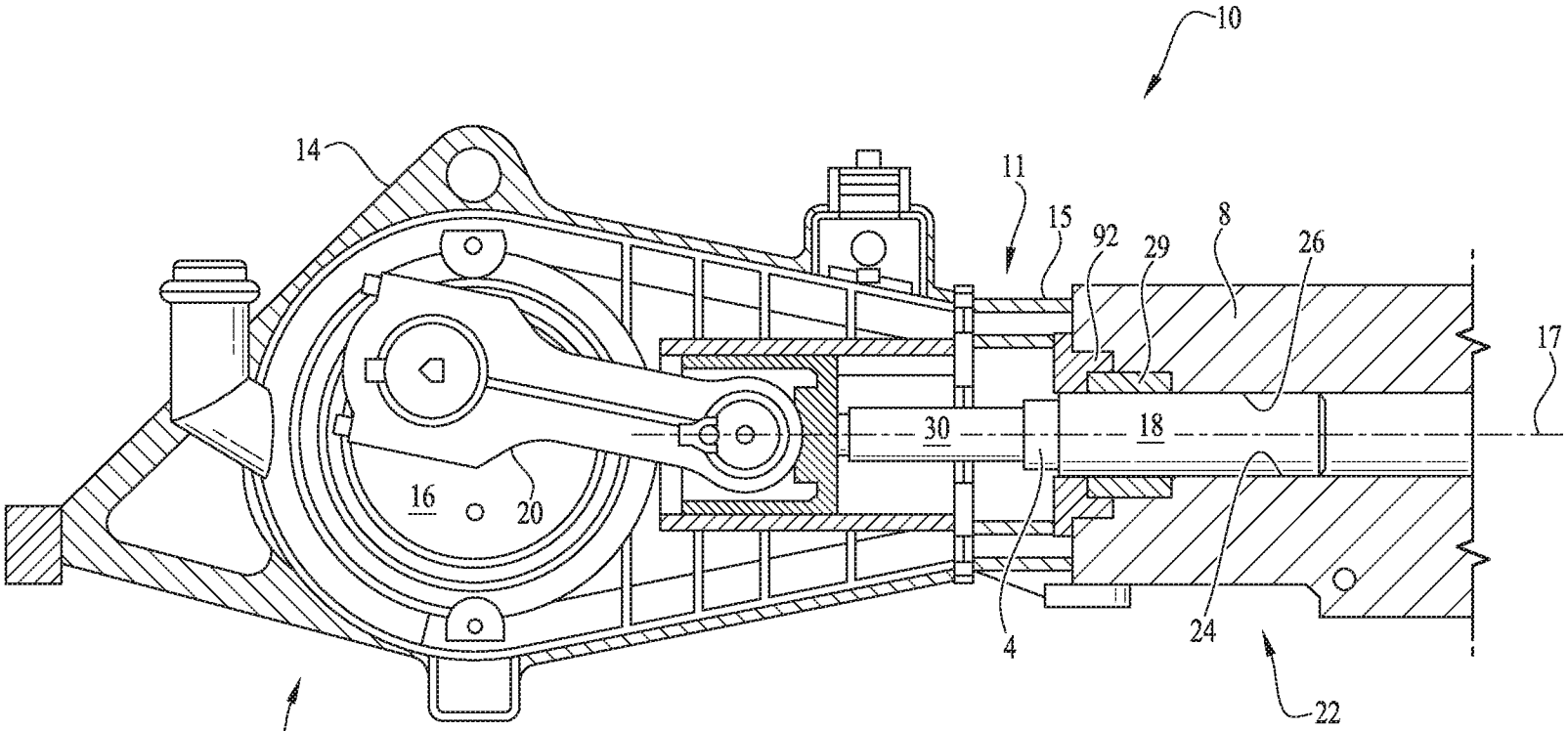
FIG. 1 is cut-away illustration of a pump power end of a pump, according to embodiments of the present disclosure.

It should be understood at the outset that although an illustrative implementation of one or more embodiments is provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Oilfield pumps typically operate outside in adverse weather conditions pumping a variety of fluids at high pressures and high flow rates to perform oilfield and/or well-servicing operations. Oilfield pumps may encounter wide environmental temperature swings from the heat of the day to the cold of the night and from weather conditions from day to day. Oilfield pumps provide a wide variety of service operations at the well site. Such operations may include, but are not limited to, drilling operations, fracturing operations, perforating operations, fluid loss operations, primary cementing operations, secondary or remedial cementing operations, or any combination of operations thereof.

Typically a high-pressure oilfield pump utilizes a plunger design to pressurize the fluid. These pumps may operate with multiple plungers to achieve the desired flow rate at high pressure. A typical high-pressure oilfield pump may utilize 3, 4, 5, or more plungers to produce a steady flow of high pressure fluid to a wellbore. These pumps may pump a wide variety of servicing fluids into the wellbore. Non-limiting examples of suitable wellbore servicing fluid include a fracturing fluid (e.g., a particle-laden fluid, as described herein), a perforating fluid, a cementitious fluid, a sealant, a remedial fluid, a drilling fluid (e.g., mud), a spacer fluid, a gelation fluid, a polymeric fluid, an aqueous fluid, an oleaginous fluid, an emulsion, various other wellbore servicing fluid.

The plunger type pumps typically are constructed with a power end providing axial force to a fluid end. The fluid end utilizes a plunger to draw in fluid through a suction valve then pressurizes the fluid inside a pump chamber until the discharge valve opens to expel the fluid. A packing assembly comprised of a packing screw, a packing carrier, and packing provides a pressure seal for the reciprocating plunger.

The seals around the plunger on high-pressure oilfield pumps may erode and begin to leak fluid past the plunger. The combination of the erosive nature of the fluids, operating temperature of the pumps, the environmental temperature of the wellsite may erode the isolating ability of the packing until the packing begins to leak fluid, sand, and debris onto the packing carrier and packing screw. These pumps may be serviced at the wellsite to replace the packing and return the pump to operation servicing the well. However, the packing screw may become difficult to remove due to the fluid, sand, and debris encountered. In some cases, a welder may be called to the location to thermally loosen the packing screw by heating, then quenching the packing screw. In extreme cases, a welder may need to cut the packing screw out of the fluid end, running the risk that the pump may be irreparably damaged.

Disclosed herein is a packing screw removal tool for removal and installation of a packing assembly from a high-pressure oilfield pump. The packing assembly comprises a packing screw, packing carrier, and a packing. The packing screw removal tool engages the packing screw at multiple locations along the outside diameter to apply torque provided by a wrench to the packing screw threads. The applied torque may loosen the screw for removal and tighten the screw during installation.

Upon positioning the packing screw removal tool proximate the packing screw, adapter pins radially align with corresponding locations along the outside diameter of the packing screw. The adapter pins are installed radially from the packing screw removal tool into the packing screw and secured in place. The adapter pins may engage the packing screw in three or more locations. The radial engagement locations may be distributed about the circumference of the packing screw to help apply torque evenly to the packing screw.

In an alternate embodiment, the adapter pins radially align with corresponding locations along the inside diameter of the packing screw. The adapter pins are installed radially from the packing screw removal tool into the packing screw and secured in place. The adapter pins may engage the packing screw in three or more locations. The radial engagement locations may be distributed about the circumference of the packing screw to help apply torque evenly to the packing screw.

The packing screw removal tool fits into a confined space located between the pump power end and pump fluid end. The confined working space may also be measured by the distance between multiple packing screws on a multiple plunger pump. The packing screw removal tool may have a reduced profile to fit between the power end and the fluid end of the pump. The packing screw removal tool may also have a reduced width and an elongated profile that allows multiple adapter pins to be installed on opposite sides of the packing screw. The reduced width also allows the packing screw removal tool to rotate a partial turn before butting against an adjacent packing screw. The packing screw removal tool may be removed, rotated, and installed for additional partial turns.

In an embodiment, the packing screw removal tool has a large wrench engagement feature on the side opposite the packing screw for a large wrench and a smaller wrench engagement feature for a smaller wrench. The large wrench engagement feature may be used with a powered wrench assembly such as an electrical power wrench or a hydraulically powered wrench. The smaller wrench engagement feature may be used with a manual wrench. The powered wrench may be utilized to apply a greater amount of torque, for example, 4000 ft-lb compared to a manual wrench.

Disclosed herein is a method of maintaining a high-pressure pump at a wellsite to return the pump to an operating condition servicing the well. The pumping crew discontinues pumping operations, isolates the pump from the high-pressure manifold, and disconnects the pump from the high-pressure manifold. The high-pressure pump may be moved to a safe location at the wellsite or returned to a servicing location. The packing screw removal tool may be attached to the packing screw on the backside of the pump. Torque may be applied to the large wrench location on the packing screw removal tool to turn the packing screw a partial turn. The packing screw removal tool may be removed and installed for additional partial turns. The pack screw and packing are removed from the fluid end. A new set of packing is installed with the packing screw. The packing screw removal tool may be used to apply torque to install the packing screw. The packing screw removal tool may then be removed from the packing screw. The high-pressure pump returns to the wellsite, is connected to the high-pressure manifold, and commences pumping operations.

Turning now to FIG. 1 a cutaway illustration of an exemplary pump 10 of this disclosure, showing an exemplary pump power end 12, integrated via integration section 11 with a pump fluid end 22, wherein the pump power end 12 is operable to reciprocate the reciprocating element 18 within a reciprocating element bore 24 of the pump fluid end 22. Briefly, for example, the pump power end 12 may include a rotatable crankshaft 16 to power a crank arm/connecting rod 20 attached to a pushrod 30 that is coupled by mechanical linkages 4 to at least one reciprocating element 18 (e.g., a plunger or piston). Additionally, an engine (e.g., a diesel engine), motor, or other suitable power sources may be operatively connected to the crankshaft 16 (e.g., through transmission and driveshaft) and operable to actuate rotation thereof. In operation, rotation of the crankshaft 16 induces translational movement of the crank arm/connecting rod 20, thereby causing the pushrod 30, mechanical linkage 4, and reciprocating element 18 to extend and retract along a flow path, which may generally be defined by a central axis 17 within a reciprocating element bore 24 (sometimes referred to herein for brevity as a "reciprocating element bore 24" or simply a "bore 24", although not wishing to be limited to a particular reciprocating element 18). Pump 10 of FIG. 1 is typically mounted on a movable structure such as a semi-tractor trailer or skid, and the moveable structure may contain additional components, such as a motor or engine (e.g., a diesel engine), that provides power (e.g., mechanical motion) to the pump power end 12 (e.g., a crankcase comprising a crankshaft 16 and related connecting rods 20).

Of course, numerous other components associated with the pump power end 12 of the pump 10 may be similarly employed, and therefore, fall within the purview of the present disclosure. Furthermore, since the construction and operation of components associated with pumps of the sort depicted in FIG. 1 are well known and understood, discussion of the pump 10 will herein be limited to the extent necessary for enabling a proper understanding of the disclosed embodiments.

The pump fluid end 22 is integrated with the pump power end 12 via the integration section 11, such that pump power end 12 is operable to reciprocate the reciprocating element 18 within a reciprocating element bore 24 (FIGS. 1-2) of the pump fluid end 22. The reciprocating element bore 24 is at least partially defined by a cylinder wall 26. As described further hereinbelow with reference to FIG. 2, pump fluid end 22 can be a cross-bore pump fluid end 22 or, alternatively, an in-line or "concentric" bore pump fluid end. As utilized herein, cross-bore pump fluid ends can comprise "T-bore" pump fluid ends, "X-bore" (e.g., cross-shaped bore) pump fluid ends, or "Y-bore" pump fluid ends.

Figure 2:
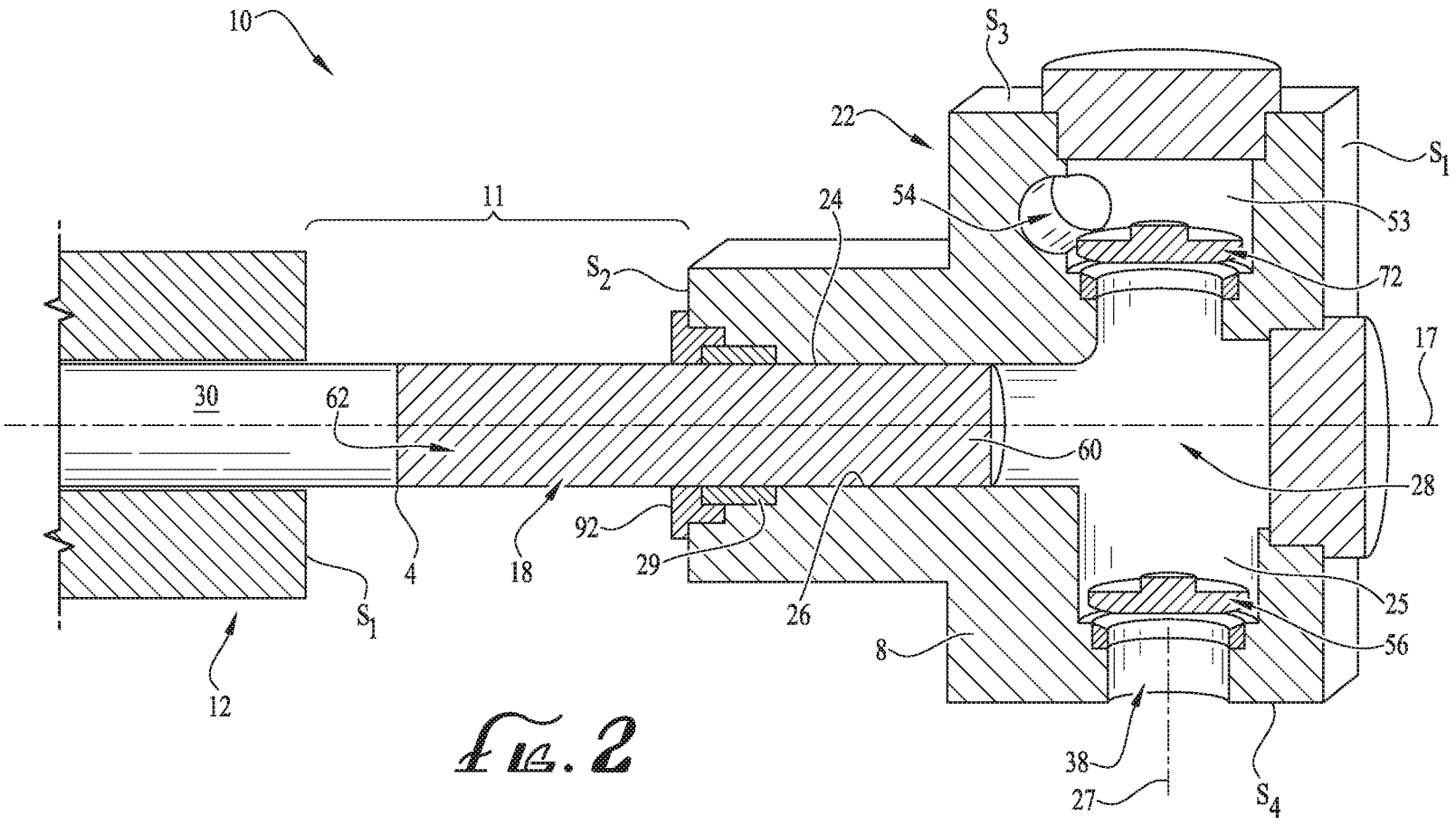
FIG. 2 is a cut-away illustration of an exemplary reciprocating pump comprising a cross-bore pump fluid end, according to embodiments of the present disclosure.

Turning now to FIG. 2, a cross-bore pump fluid end 22 is illustrated engaged with a reciprocating element 18. The pump 10 includes at least one fluid inlet 38 for receiving fluid from a fluid source, e.g., a suction line, suction header, storage or mix tank, blender, discharge from a boost pump such as a centrifugal pump, etc. The pump 10 also includes at least one discharge outlet 54 for discharging fluid to a discharge source, e.g., a flowmeter, pressure monitoring and control system, distribution header, discharge line, wellhead, discharge manifold pipe, and the like.

One or more seals 29 (e.g., "o-ring" seals, packing seals, or the like), also referred to herein as 'primary' reciprocating element packing 29 may be arranged around the reciprocating element 18 to provide sealing between the outer walls of the reciprocating element 18 and the cylinder walls 26 defining at least a portion of the reciprocating element bore 24. Packing 29 can be any suitable packing known to those of skill in the art and with the help of this disclosure. The packing 29 may comprise an elastomeric material, a plurality of rings of elastomeric material, may comprise one, two, three, four, or more of rings of elastomeric material. Skilled artisans will recognize that the seals may comprise any suitable type of seals, and the selection of seals may depend on various factors, e.g. fluid, temperature, pressure, etc.

A pump 10 of this disclosure may have limited access to packing 29 in FIG. 2 due to the location within the integration section 11. The integration section 11 can be positioned in a space between the pump fluid end 22 and the pump power end 12, and can be safeguarded (e.g., from personnel) via a cover 15. Locations described as front S1, back S2, top S3, and bottom S4 can be relative to a surface (e.g., a trailer bed, the ground, a platform, etc.) upon which the pump 10 is located, a bottom S4 of the pump fluid end being proximal the surface (e.g., trailer bed) upon which the pump 10 is located. Generally, due to the size and positioning of pump 10, the front S1 and top S3 of the pump fluid end 22 are more easily accessible than a back S2 or bottom S4 thereof. In a similar manner, a front of pump 10 is distal the pump power end 12, and the back of the pump 10 is distal the pump fluid end 22.

Figure 3:
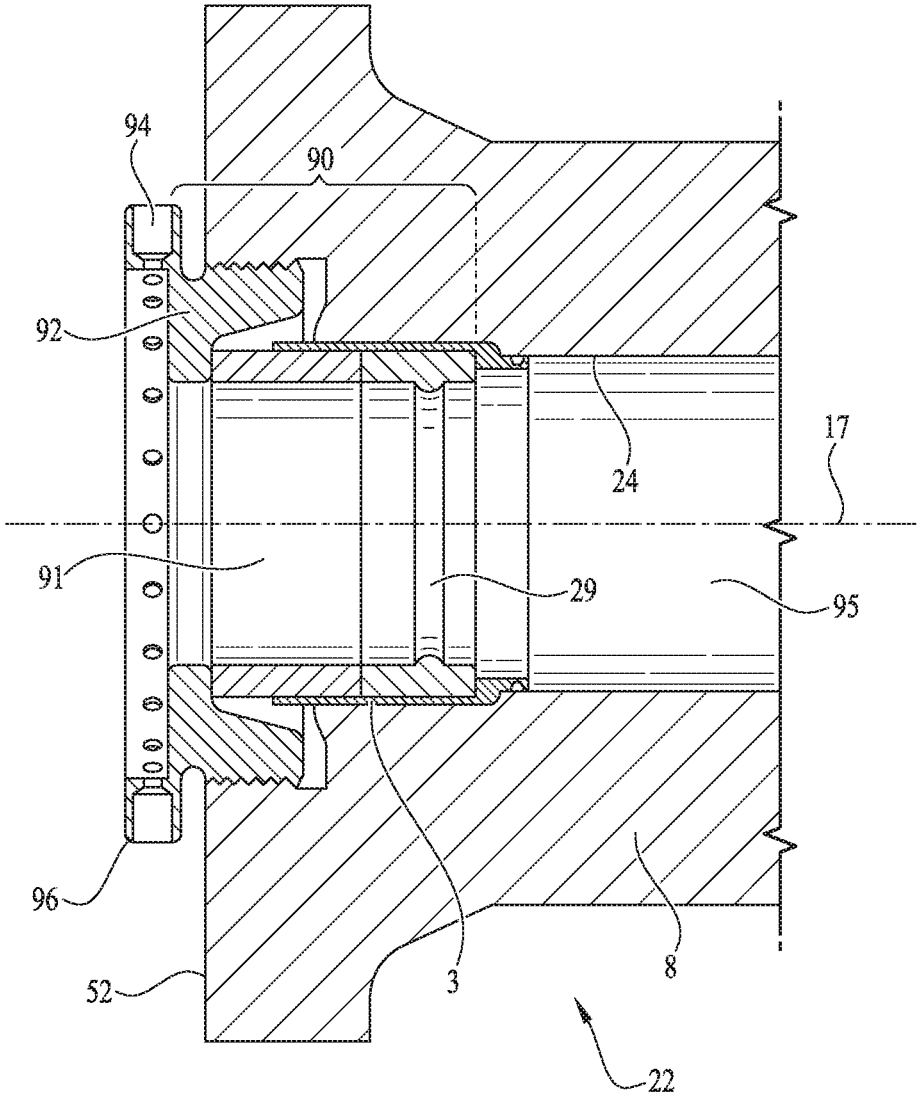
FIG. 3 is a cut-away illustration of a pump comprising a packing assembly of this disclosure.

FIG. 3 is a cut-away illustration of a packing assembly 90 of this disclosure in pump fluid end 22. Packing assembly 90 comprises a packing screw 92, a packing carrier 91, and a packing 29. Packing screw 92, packing carrier 91, and packing 29 are cylindrical and have a width measured an axial distance along a central axis that is less than the distance between the pump power end 12 and the pump fluid end 22 to allow for removal. The packing screw 92 has radial locations 94 evenly distributed about the circumference of the outer surface 96. The radial locations 94 may be drilled holes, broached square or hex shapes, castellation, or other similar features.

Figure 4:
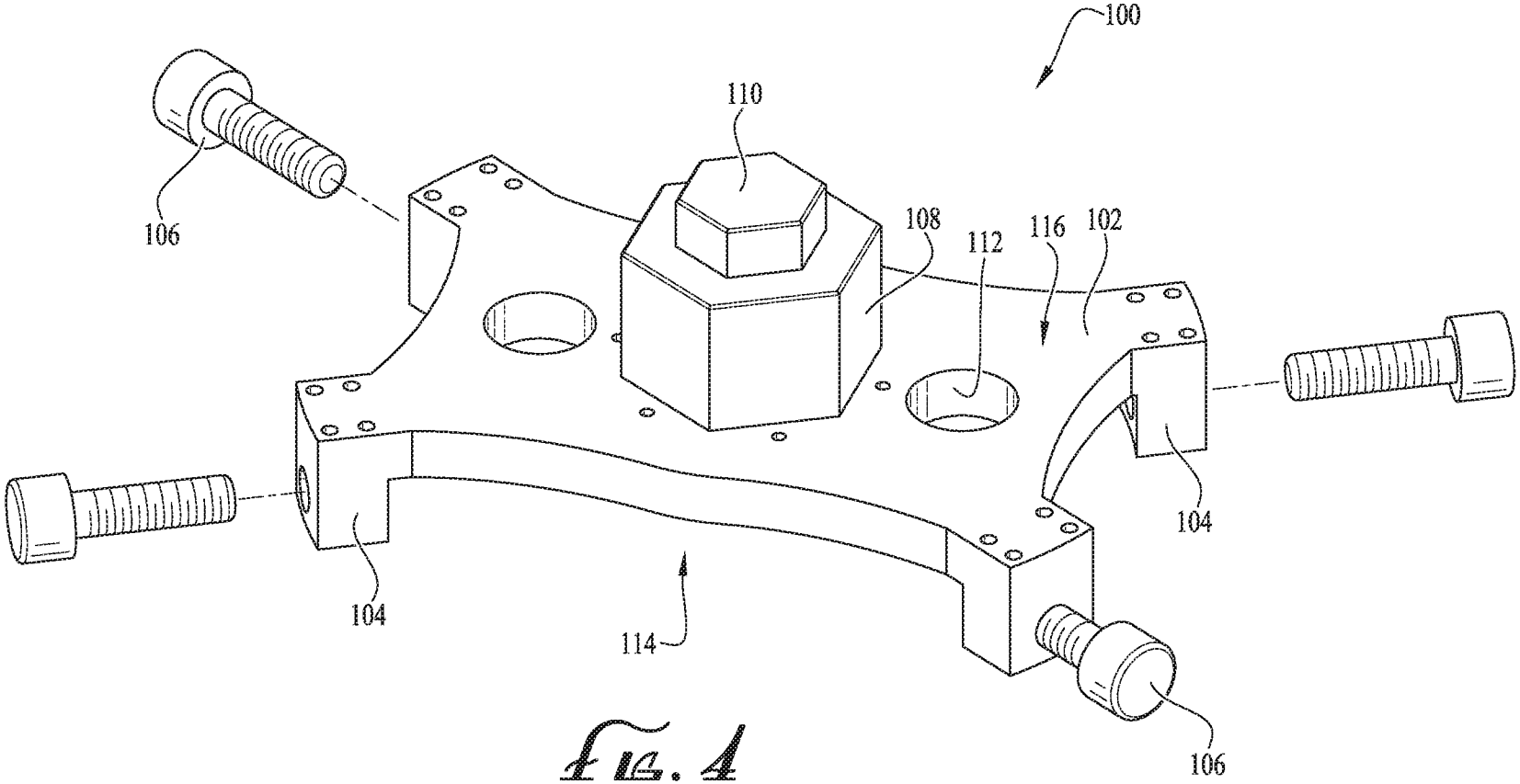
FIG. 4 is an isometric view of the packing screw removal tool according to embodiments of the present disclosure.

Turning now to FIG. 4, a packing screw removal tool 100 for removal or installation of a packing screw is described. The packing screw removal tool 100 comprises main body 102, dogs 104, locking pins 106, the central engagement feature 108, the secondary engagement feature 110, and apertures 112. The main body 102 may be made from plate-like material typically having two substantially parallel faces/sides: a packing screw engaging side 114 (facing the packing screw when in use) and a lever engaging side 116 (facing away from the packing screw when in use).

The packing screw engagement side 114 of the main body 102 has dogs 104 projecting outwards and spaced apart to allow engagement with the packing screw 92. The dogs 104 may be formed in place (machined from a single piece of material, extruded, or sintered) with the main body 102 or may be attached to the main body 102 by welding, brazing, or fasteners such as screws or bolts. The dogs 104 retain locking pins 106 in place. The locking pins 106 may be installed from the outside surface of the dogs 104 to engage radial locations 94 along the outer surface 96 of the packing screw 92. The locking pins 106 may be screws, bolts, pins, latches, or any other type of fastener known to the arts.

In an alternate embodiment, the locking pins 106 may be installed from the inside surface of the dogs 104 to engage radial locations 94 along the inner surface of the packing screw 92.

In an embodiment, the lever engaging side 116 of the main body 102 has a central engagement feature 108 and secondary engagement feature 110 projecting outwards. In some contexts, the engagement feature may be referred to as a torque transfer engagement post. The central engagement feature 108 may engage a manual tool or an electrically or hydraulically powered mechanical assembly (powered wrench) for the application of torque. The central engagement feature 108 may engage a manual tool, for example, a hand wrench (not shown) for the application of torque. The central engagement feature 108 may be a hex nut with six equally spaced parallel sides for engagement with a standard-sized (ANSI or metric) wrench. The central engagement feature 108 projection length would typically establish full engagement with the manual wrench or the powered wench. The lever engaging side 116 of the main body 102 has a secondary engagement feature 110 projecting outwards from the central engagement feature 108. The secondary engagement feature 110 is typically smaller in size to engage a smaller standard-sized (ANSI or metric) wrench. The secondary engagement feature 110 allows for smaller wrench use when moderate torque is desired to rotate the packing screw. Even though the central engagement feature 108 and secondary engagement feature 110 are described as a hex nut the central engagement feature 108 and secondary nut could be made to any similar fastener shape: square, pentagon, hex, double-square, double-hex, Torx, external Torx, Pentalobe, or other similar shapes.

An alternate embodiment for the secondary engagement feature 110 may be an inward projection of an engagement shape such as a hex socket projected into the central engagement feature 108. The hex socket shape of the secondary engagement feature 110 would then engage a hex key, Allen key, or Allen wrench. A hex key is typically manufactured with tight tolerances to fit tightly into the corresponding socket shape. Even though the secondary engagement feature 110 inward projection is described as a hex socket, the inward projection could be made to any similar socket shape: square, pentagon, hex, double-square, double-hex, Torx, external Torx, pentalobe, or other socket shapes.

Figure 5:
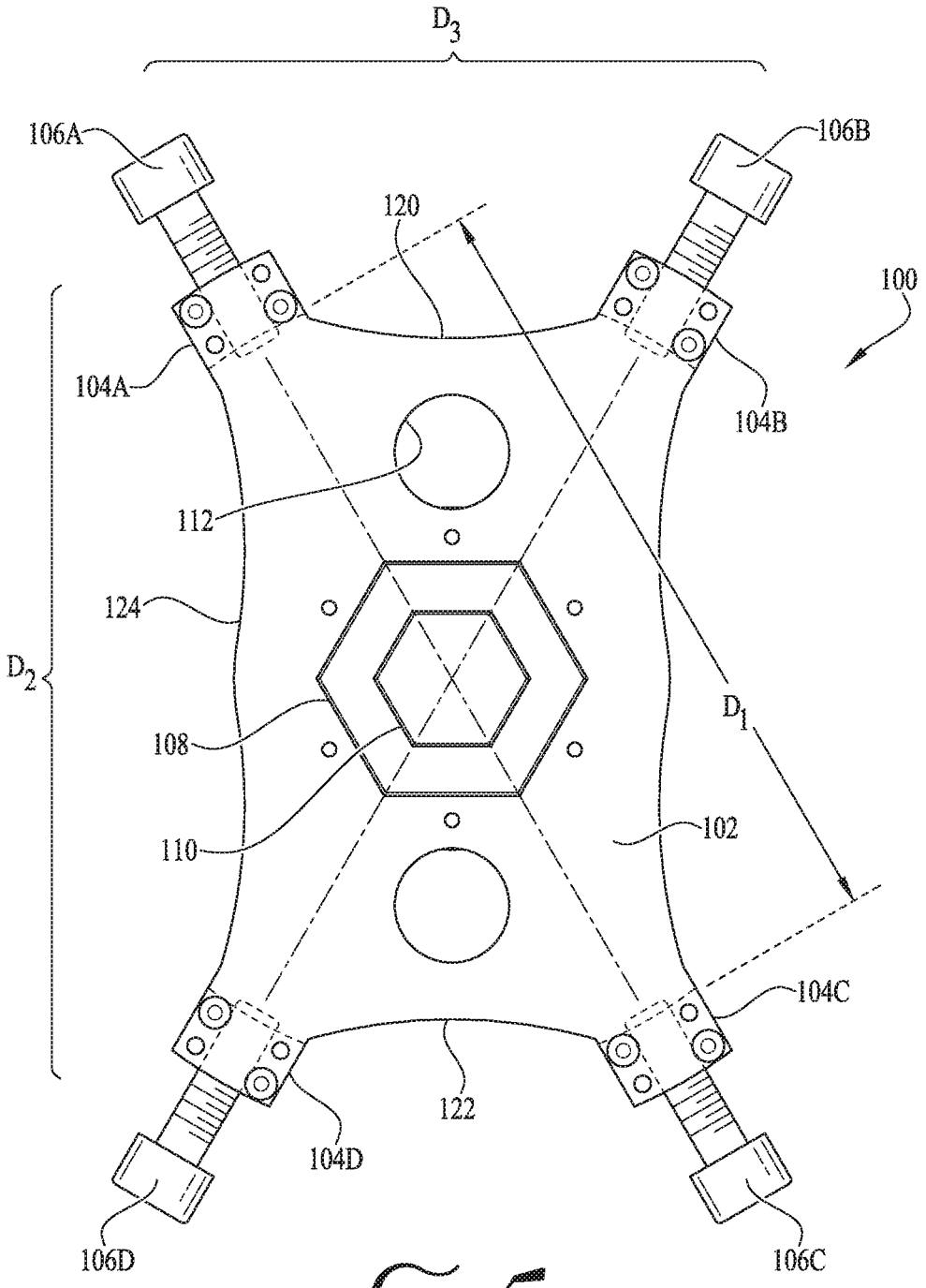
FIG. 5 is a top view of the packing screw removal tool according to embodiments of the present disclosure

The shape of the packing screw removal tool 100, in an embodiment, is further discussed with reference to FIG. 5 with a top view showing distance D1 between two dogs 104 spaced about 180 degrees apart. The distance D1 between dogs 104 allows for a slip fit or a fit with an allowance for movement, between the outside diameter of the packing screw defined by the outer surface 96 in FIG. 3 and the dogs 104. The packing screw removal tool 100 has four locking pins 106 with locking pin 106A and locking pin 106B radially spaced apart by about 60 degrees around the central axis perpendicular to the flat side of the main body 102. Locking pin 106C is located about 120 degrees from locking pin 106D about the perpendicular axis. Locking pin 106D is located about 60 degrees from locking pin 106C, and the first locking pin 106A is located about 120 degrees from locking pin 106D. The distance D2 is measured across the long side of the packing screw removal tool 100 and defines the length of the tool spanning the outside diameter of the packing screw 92. The distance D3 defines the width of the short side 120 of the packing screw removal tool 100 between the locking pins rotated about 60 degrees apart.

In an embodiment, the angle between the locking pins 106A and 106B on the short side of the packing screw removal tool 100 may be about 60 degrees, about 50 degrees, about 45 degrees, or about 30 degrees and function as described. The locking pins 106 align with the radial locations 94 on the packing screw 92. The angle between the locking pins 106A and 106B on the short side of the packing screw removal tool 100 could be any acute angle and function as described.

The packing screw removal tool 100 transmits the torque applied to the central engagement feature 108 or alternatively the secondary engagement feature 110 through the main body 102 to the dog 104, to the locking pins 106, and into the packing screw radial locations 94. The packing screw removal tool 100 distributes the applied torque to the number of locking pins 106 installed in the packing screw radial locations 94 on the packing screw 92. The angular location of the locking pins 106 aligns with the angular location of the packing screw radial locations 94 along the outside diameter of the packing screw 92. Alternatively, the angular location of the locking pins 106 aligns with the angular location of the packing screw radial locations 94 along the inside diameter of the packing screw 92. The aligned dogs and packing screw radial locations may be spaced 70 degrees or less apart on the short side of the tool with the distance D3. The packing screw removal tool 100 may have 2 or more dogs 104 and locking pins 106 on the short side of the tool that aligns with packing screw radial locations 94. The packing screw removal tool 100 may have the same number of dogs 104 and locking pins 106 on opposite short sides of the main body 102. The packing screw removal tool 100 may have a different number of dogs 104 and locking pins 106 on opposite short sides of the main body 102.

Figure 6:
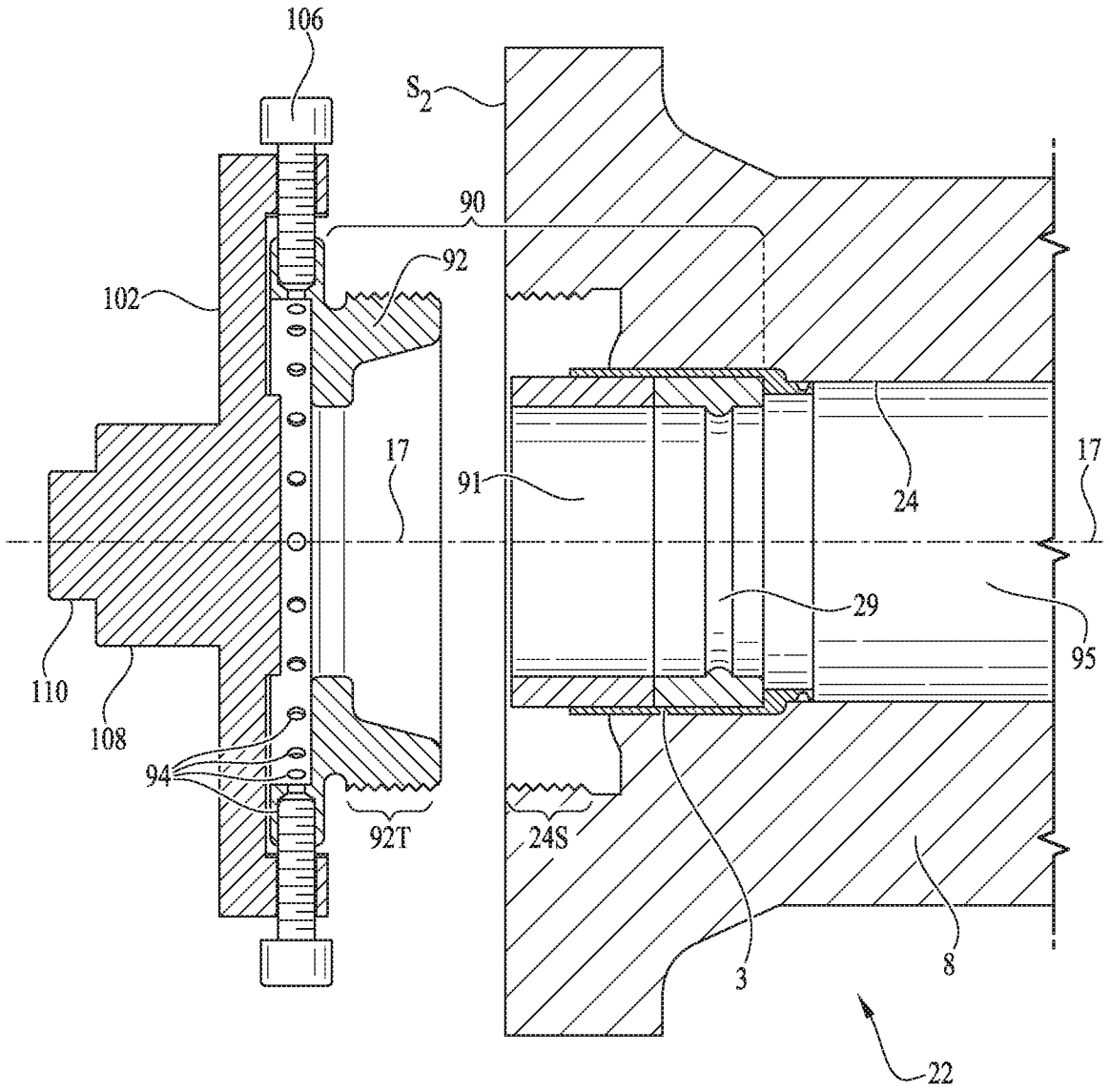
FIG. 6 is a cut-away illustration of a pump comprising a packing assembly of this disclosure, with a packing screw removal tool according to embodiments of the present disclosure.
Figure 7:
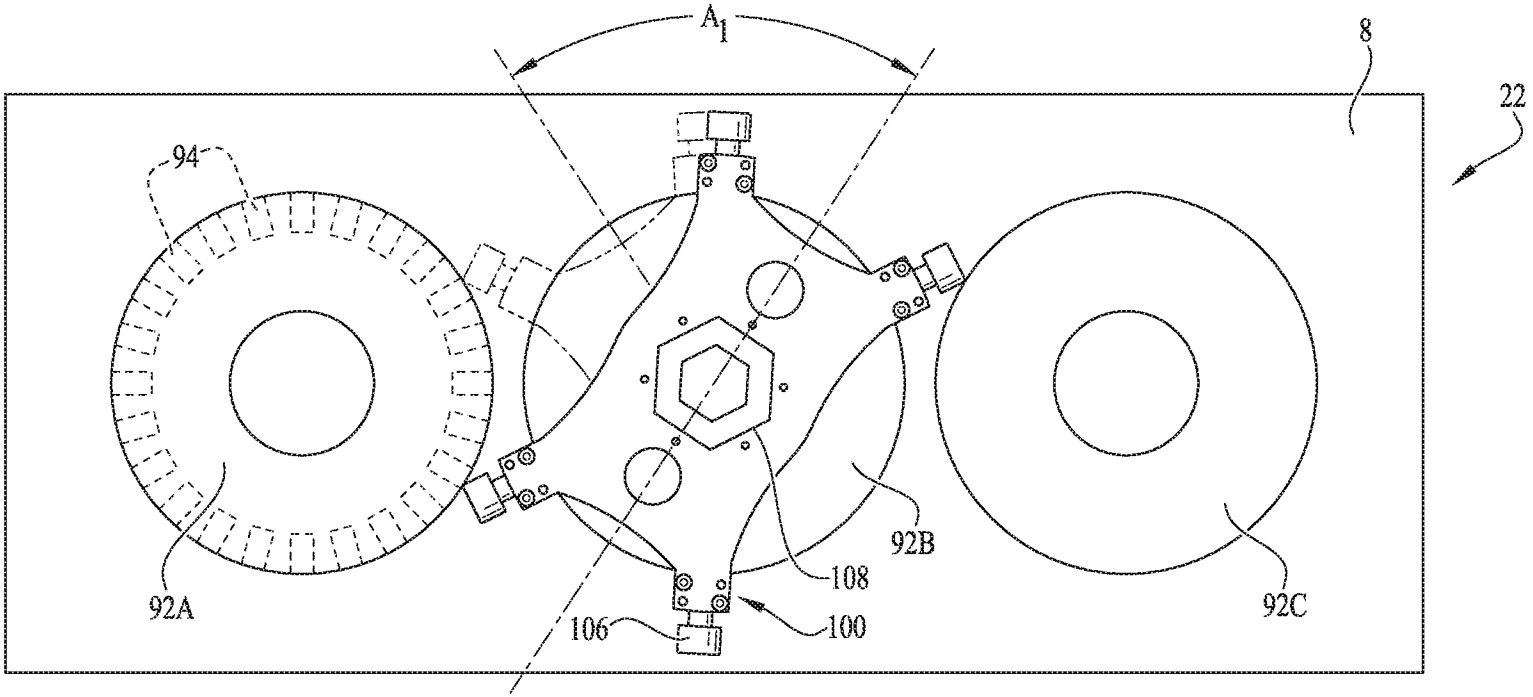
FIG. 7 is a front view of a pump fluid end with a packing screw removal tool according to embodiments of the present disclosure.

Turning now to FIG. 6, a packing assembly 90 is installed in the reciprocating element bore 24 of the fluid end body 8. The packing assembly 90 is comprised of packing screw 92, primary packing 29, and packing carrier 91 installed in packing sleeve 3 inside the reciprocating element bore 24. A high level of torque may need to be applied to remove the packing screw 92 to access the primary packing 29. A packing screw removal tool 100 is installed on the packing screw 92 in FIG. 3 and FIG. 6 by aligning the locking pins 106 to the packing screw radial locations 94 and radially installing the locking pins 106 into the packing screw 92. Torque may be applied to the central engagement feature 108 or the secondary engagement feature 110 to transfer torque through the locking pins 106 installed into the packing screw 92 to unthread the packing screw 92 from the fluid end body 8. A packing screw removal tool 100 may be used on a multiple plunger pump with 3 or more plungers, as shown in FIG. 7. The packing screw removal tool 100 is placed on packing screw 92B that is located between packing screws 92A and 92C on pump fluid end 22. The packing screw removal tool 100 may rotate a partial turn of angular distance μl when torque is applied to central engagement feature 108 or secondary engagement feature 110. The angular distance μl may be defined as the distance the centerline of the packing screw removal tool 100 rotates about the central engagement feature 108. The angular distance is constrained by the width of the packing screw removal tool 100 defined by distance D3 and the proximity of packing screw 92A, 92B, and 92C. The locking pins 106 may be disengaged from the packing screw 92B and the packing screw removal tool 100 may be rotated and reinstalled a second time for another partial rotation defined as angular distance μl. Although the packing screw removal tool 100 is shown installed on the outside of the packing screw 92, it is understood that the packing screw removal tool 100 could be installed on the inside of the packing screw 92.

Figure 8:
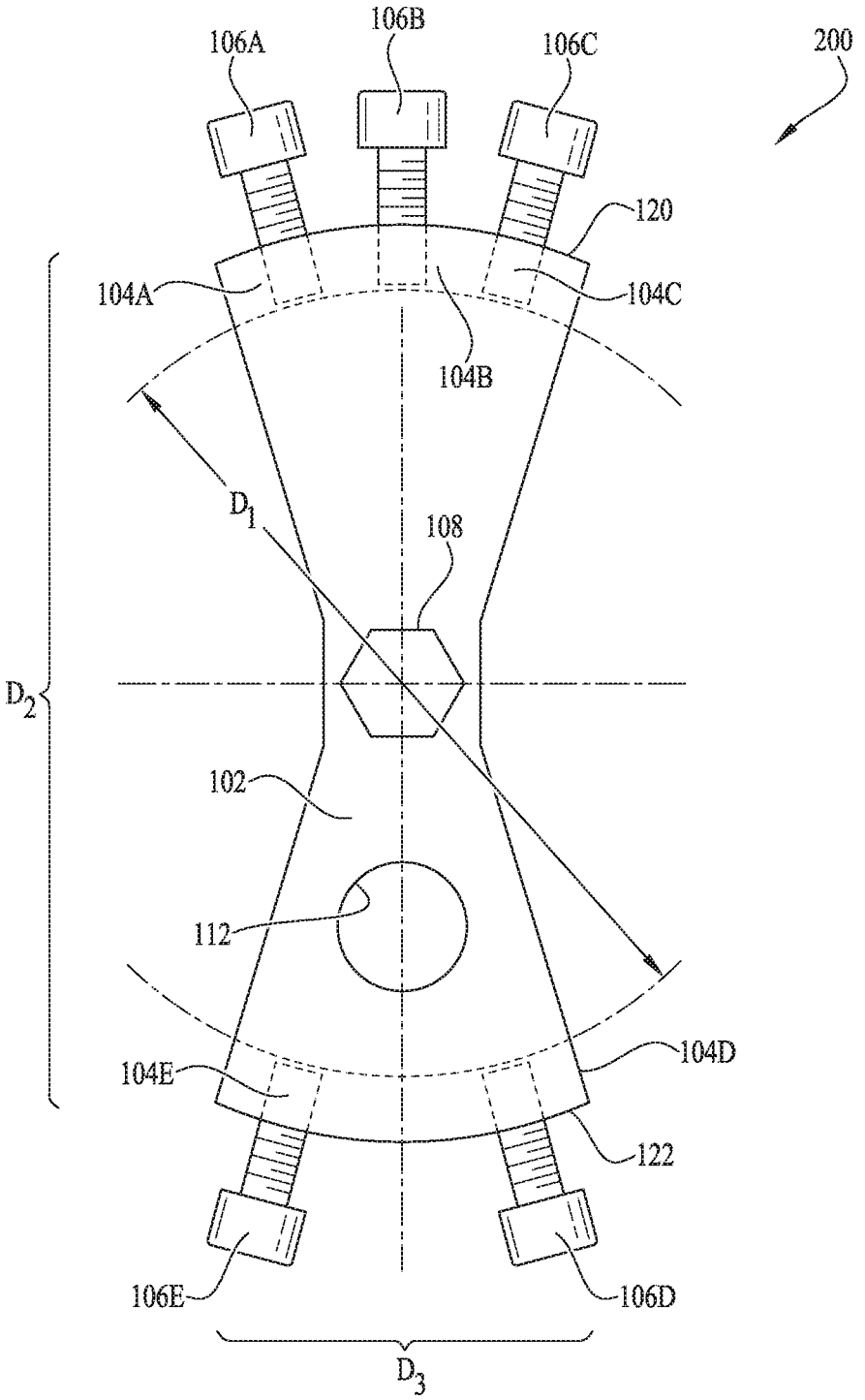
FIG. 8 is a top view of the packing screw removal tool according to embodiments of the present disclosure

An alternate embodiment of a packing screw removal tool 200 shown in FIG. 8 has three dogs 104A-C and locking pins 106A-C, on the short side 120 and two dogs 104D-E and locking pins 106D-E on the opposite short side 122. The three dogs 104A-C and locking pins 106A-C on the short side 120 may align with sequential corresponding packing screw radial location 94 on the packing screw 92. For example, if the packing screw 92 has 36 radial locations 94 spaced 10 degrees apart, three dogs 104A-C and locking pins 106A-C may be spaced 10 degrees apart; dog 104B is rotated 10 degrees from dog 104A and dog 104C is rotated 10 degrees from 104B. Likewise, if the packing screw 92 has 24 radial locations 94 spaced 15 degrees apart, three dogs 104A-C and locking pins 106A-C may be spaced apart 15 degrees; dog 104B is rotated 15 degrees from dog 104A and dog 104C is rotated 15 degrees from 104B. The two dogs D-E and locking pins D-E on the opposite short side 122 may align with corresponding packing screw radial locations 94 on the packing screw 92 that are spaced a multiple of the angular location. For example, if the packing screw 92 has 36 radial locations 94 spaced 10 degrees apart, two dogs 104D-E and locking pins 106D-E may be spaced 20 degrees, 30 degrees, or some other multiple of 10 degrees apart. Likewise, if the packing screw 92 has 24 radial locations 94 spaced 15 degrees apart, the two dogs 104D-E and locking pins 106D-E may be spaced 15 degrees, 30 degrees, or some other multiple of 15 degrees apart. One or more of the three dogs 104 A-C on the short side 120 may be spaced a multiple of the angular location without deviating from the scope of the embodiment. In an alternate embodiment, the locking pins 106 A-E could be installed from the inside of the dogs 104 A-E attach to the inside of the packing screw 92.

A pump 10 may begin losing pressure pumping ability, and fluid may begin leaking from packing 29 due to extended pumping service, erosive nature of the fluid, fluid composition, environmental condition, or a combination of factors. The fluid may begin to leak from the pump chamber 28, through the packing 29, past the packing carrier 91, and out around the packing screw 92. Any fluid leak will reduce the ability of the pump to pressurize the fluid and reduce the flow rate. In addition, the leaking fluid may pose an environmental hazard that requires clean up.

The pumping crew may desire to repair the leaking packing at the wellsite to return the pump 10 to servicing the well. The pumping crew would cease pumping operations and isolate the pump from a high-pressure line or a high-pressure manifold connected to the wellhead. The pump 10 would then be disconnected from the supply line and high-pressure line and moved a safe distance away.

The pumping crew may prepare the pump 10 for removal of the packing screw 92 by disconnecting various components, cleaning spills, or removing parts. The pumping crew may remove the mechanical linkage 4 and the reciprocating element 18 from the pump 10 for access to the packing assembly 90.

A packing assembly 90 can be removed from pump fluid end 22 by applying torque with the packing screw removal tool 100 to unscrew the packing screw 92. The packing screw removal tool 100 is aligned with the radial locations 94 along the packing screw 92, and the locking pins 106 are radially engaged with the radial locations 94. Torque is applied to the central engagement feature 108 or the secondary engagement feature 110 to unthread the packing screw 92 a partial turn defined by A1 in the limited space between packing screws. The packing screw removal tool may be decoupled from the packing screw 92 by disengaging the locking pins 106 from the radial locations. The packing screw removal tool 100 may then be aligned a second time for a second partial turn. The packing screw removal tool 100 may be engaged for multiple partial turns until the packing screw 92 unthreads from the pump fluid end body 8. That is, the packing screw 92 can be decoupled from the pump fluid end body 8 (e.g., by dethreading the threads on the portion 92T of the outside diameter of packing screw 92 that is threaded from the corresponding threads on the portion 24S of the inside diameter of the reciprocating element bore 24 and/or packing sleeve 95 that is threaded), removing packing screw 92 from reciprocating element bore 24, via the back S2 of pump fluid end 22, removing packing carrier 91 from reciprocating element bore 24 via the back S2 of pump fluid end 22, and removing packing 29 from reciprocating element bore 24 via the back S2 of pump fluid end 22. The pumping crew may then complete the servicing of the pump 10 on location by replacing one or more eroded parts such as the packing 29, the packing carrier 91, and the packing screw 92.

Figure 9:
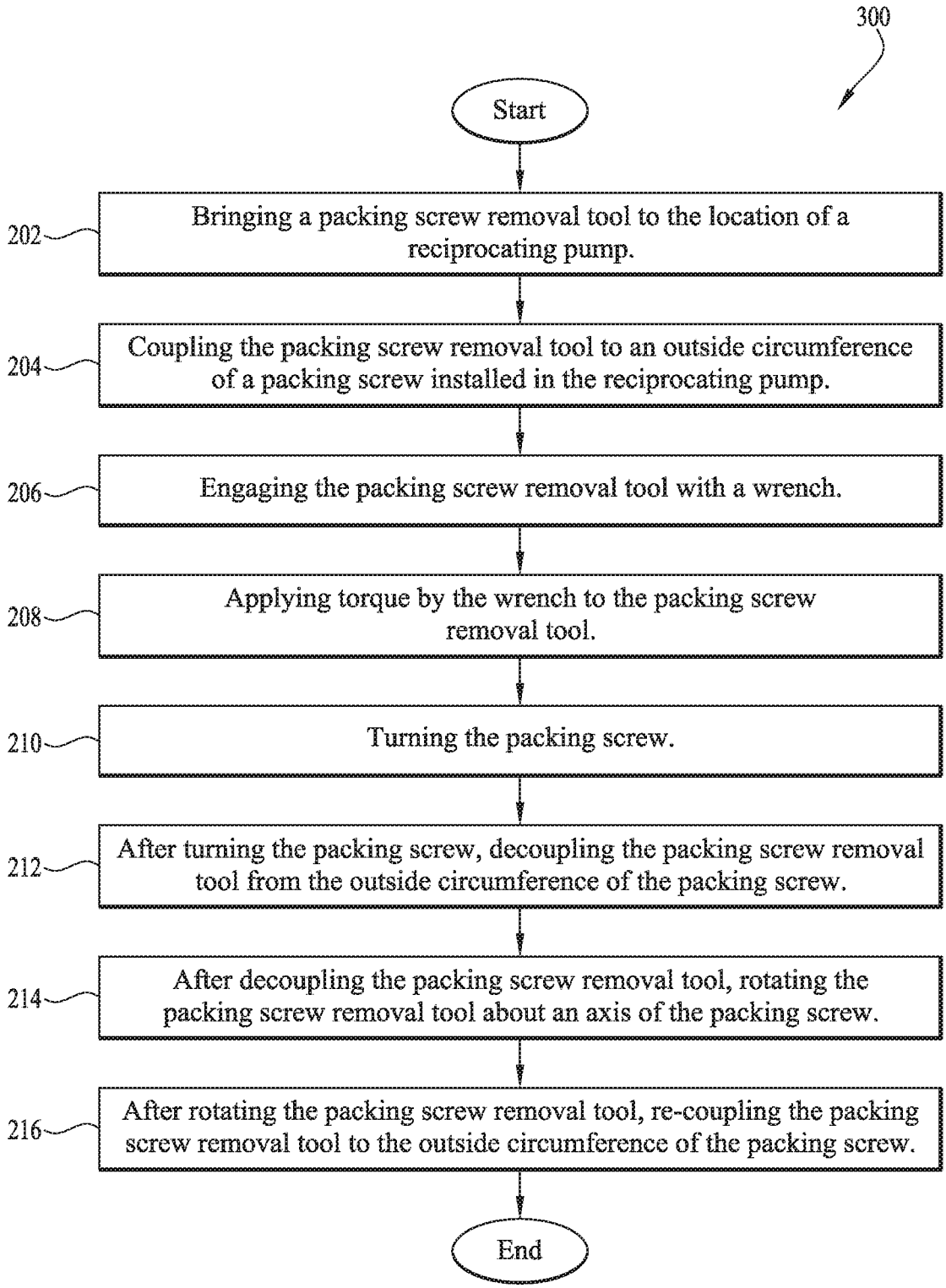
FIG. 9 is a flow chart of a method according to an embodiment of the disclosure.

Turning now to FIG. 9, a method 300 is described. In an embodiment, the method 300 comprises a method of removing a packing screw with a packing screw removal tool. At block 202, the method 300 comprises bringing a packing screw removal tool 100 to the location of a reciprocating pump. The location of the pump 10 may be a wellsite or a service location. The packing screw removal tool 100 may be brought with the pump to a wellsite or transported to the wellsite on a separate trip. The packing screw removal tool 100 may be located at a servicing location or brought to the servicing location.

At block 204, the method 300 comprises coupling a packing screw removal tool to an outside circumference of a packing screw installed in the reciprocating pump. The packing screw removal tool 100 is aligned with the radial locations 94 along the packing screw 92, and the locking pins 106 are radially engaged with the radial locations 94. Alternately, the packing screw removal tool may be coupled to the inside of a packing screw and the locking pins 106 radially engage with the radial locations 94.

At block 206, the method 300 comprises engaging the packing screw removal tool with a wrench. A manual wrench or powered wrench may engage the central engagement feature 108. A manual wrench or a powered wrench may engage the secondary engagement feature 110. In an alternate embodiment, a hex key or an Allen wrench may engage the secondary engagement feature 110.

At block 208, the method 300 comprises applying torque by the wrench to the packing screw removal tool. Torque is applied with either a powered wrench or a manual wrench to the central engagement feature 108 or the secondary engagement feature 110.

At block 210, the method 300 comprises turning the packing screw. The packing screw is rotated by the torque applied to the engagement feature on the packing screw removal tool 100.

At block 212, the method 300 comprises after turning the packing screw, decoupling the packing screw removal tool from the outside circumference of the packing screw. In an embodiment, the four locking pins 106 are radially disengaged from the packing screw radial locations 94. Alternatively, the packing screw removal tool may be decoupled form the inside circumference of the packing screw.

At block 214, the method 300 comprises after decoupling the packing screw removal tool, rotating the packing screw removal tool about an axis of the packing screw. The packing screw removal tool 100 is rotated about the center axis of the packing screw 92 to realign the dogs 104 with the packing screw radial locations 94.

At block 216, the method 300 comprises after rotating the packing screw removal tool, re-coupling the packing screw removal tool to the outside circumference of the packing screw. The packing screw removal tool 100 is aligned with the radial locations 94 along the packing screw 92, and the locking pins 106 are radially engaged with the radial locations 94.

A packing assembly of this disclosure can be assembled in a pump fluid end 22 by inserting the packing 29 into reciprocating element bore 24 (or a sleeve inserted therein) from back S2 of pump fluid end 22, packing carrier 91 can be inserted into reciprocating element bore 24 from back S2 of pump fluid end 22, and packing screw 92 can be inserted into reciprocating element bore 24 from back S2 of pump fluid end 22. Once packing screw 92 is inserted, it can be coupled with pump fluid end body 8 (e.g., via threading the threads on the portion 92C of the outside diameter of packing screw 92 that is threaded with corresponding threads on the portion 24A of the inside diameter of the reciprocating element bore 24 and/or packing sleeve 95 that is threaded). Initially, the threading of the threads may require little or no torque until the packing screw 92 encounters packing carrier 91 or, in some cases, the fluid end body 8. The packing screw removal tool 100 is aligned with the radial locations 94 along the packing screw 92, and the locking pins 106 are radially engaged with the radial locations 94. Torque is applied to the central engagement feature 108 or the secondary engagement feature 110 to apply torque to retain the packing screw 92 to the fluid end body 8. Once coupled, packing screw 92 retains packing carrier 91 and packing 29 within reciprocating element bore 24 (and/or within a packing sleeve 95 therein).

As noted hereinabove, the packing screw removal tool 100 may be utilized on a packing screw 92 found on a multi-cylinder pump comprising multiple cylindrical reciprocating element bores 24 and corresponding components. In embodiments, the pump 10 is a Triplex pump in which the pump fluid end 22 comprises three reciprocating assemblies, each reciprocating assembly comprising a suction valve assembly 56, a discharge valve assembly 72, a pump chamber 28, a fluid inlet 38, a discharge outlet 54, and a reciprocating element bore 24 within which a corresponding reciprocating element 18 reciprocates during operation of the pump 10 via connection therewith to a (e.g., common) pump power end 12. In embodiments, the pump 10 is a Quintuplex pump in which the pump fluid end 22 comprises five reciprocating assemblies. In a non-limiting example, the pump 10 may be a Q-10™ Quintuplex Pump or an HT-400™ Triplex Pump, produced by Halliburton Energy Services, Inc.

Those of ordinary skill in the art will readily appreciate various benefits that may be realized by the present disclosure. For instance, the utilization of a packing screw removal tool 100, as described herein, can facilitate removal and replacement of components of packing assembly 90 within pump fluid end 22. Due to utilization of a packing assembly 90 as described herein, wherein the removal of the packing screw 92 from the pump fluid end 22 to remove and replace packing 29, packing carrier 91 without damaging the pump fluid end 22. In embodiments, utilization of a set of locking pins 106 to engage with radial locations 94 on the packing screw distributes torque along the packing screw 92. The locking pins 106 align and releasably engage with the packing screw radial locations 94. In embodiments, two locking pins 106 may be located at 60 degrees on the short side of the packing screw removal tool 100, and two locking pins 106 may be located 180 degrees from the first set.

A power wrench may apply torque to the central engagement feature 108 to transmit torque through the main body 102 to the dog 104 to the locking pins 106 and into the packing screw radial locations 94 to unthread the packing screw 92 form the fluid end body 8. A manual wrench may apply torque to a secondary engagement feature 110 to transmit torque through the main body 102 to the dog 104 to the locking pins 106 and into the packing screw radial locations 94 to unthread the packing screw 92 form the fluid end body 8. The torque applied to the packing screw removal tool 100 may rotate the packing screw 92 a partial turn. The packing screw removal tool 100 may be disengaged from the packing screw 92 and reengaged for multiple partial turns to unthread the packing screw 92 from the fluid end body 8. Accordingly, utilization of the packing screw removal tool 100 of this disclosure on a packing screw 92 in a pump fluid end 22 of a pump 10 can avoid damage from cutting out a packing screw 92 and can provide for a reduction in pump fluid end 22 maintenance time by at least 10, 20, 30, 40, or 50% relative to removing a packing screw 92 from a pump fluid end 22 without utilizing a packing screw removal tool 100. A reduction in pump fluid end 22 maintenance and/or assembly time reduces exposure of workers performing the maintenance (and thus potentially enhances safety) and also reduces non-productive time on location.

ADDITIONAL DISCLOSURE

The following are non-limiting, specific embodiments in accordance with the present disclosure.

A first embodiment, which is a packing screw removal tool, comprising a tool body; a plurality of packing screw engagement dogs coupled to the tool body, wherein the engagement dogs are asymmetrically disposed about an axis of rotation of the packing screw removal tool, and a torque transfer engagement post coupled to the tool body.

A second embodiment, which is the packing screw removal tool of the first embodiment, wherein the torque transfer engagement post defines a first engagement feature dimensioned to be engaged by a first wrench size.

A third embodiment, which is the packing screw removal tool of the second embodiment, wherein the first engagement feature is a triangular column, a square column, a pentagonal column, a hexagonal column, or an octagonal column.

A fourth embodiment, which is the packing screw removal tool of the second embodiment, wherein the torque transfer engagement post further defines a second engagement feature dimensioned to be engaged by a second wrench size, where the second wrench size is smaller than the first wrench size.

A fifth embodiment, which is the packing screw removal tool of the fourth embodiment, wherein the second wrench size is recessed into the first engagement feature.

A sixth embodiment, which is the packing screw removal tool of one of the first, the second, the third, or the fourth embodiment, wherein the packing screw removal tool comprises four packing screw engagement dogs.

A seventh embodiment, which is the packing screw removal tool of the first embodiment, wherein the tool body has a plate shape, a first packing screw engagement dog and a second packing screw engagement dog are located within 60 degrees on a minor axis of the tool body on a short side of the packing screw removal tool 100.

An eighth embodiment, which is the packing screw removal tool of the seventh embodiment, wherein a third packing screw engagement dog and a fourth packing screw engagement dog are located within 60 degrees on a minor axis of the tool body on the opposite short side of the packing screw removal tool 100.

A ninth embodiment, which is the packing screw removal tool of the seventh embodiment, wherein three packing screw engagement dogs are located within 60 degrees on the opposite short side of the tool body of the packing screw removal tool 100.

A tenth embodiment, which is a method of removing a packing screw of a reciprocating pump, comprising bringing a packing screw removal tool to the location of a reciprocating pump, coupling the packing screw removal tool to an outside circumference of a packing screw installed in the reciprocating pump, engaging the packing screw removal tool with a wrench, applying torque by the wrench to the packing screw removal tool, turning the packing screw, after turning the packing screw, decoupling the packing screw removal tool from the outside circumference of the packing screw, after decoupling the packing screw removal tool, rotating the packing screw removal tool about an axis of the packing screw, and after rotating the packing screw removal tool, re-coupling the packing screw removal tool to the outside circumference of the packing screw.

An eleventh embodiment, which is the method of the tenth embodiment, wherein the wrench is a powered wrench.

A twelfth embodiment, which is the method of the tenth embodiment, wherein the packing screw removal tool comprises a tool body, a plurality of packing screw engagement dogs coupled to the tool body, wherein the engagement dogs are asymmetrically disposed about an axis of rotation of the packing screw removal tool, and a torque transfer engagement post coupled to the tool body.

A thirteenth embodiment, which is the method of the twelfth embodiment, wherein engaging the packing screw removal tool with the wrench comprises engaging a working feature of the wrench with a first engagement feature of the torque transfer engagement post.

A fourteenth embodiment, which is the method of the thirteenth embodiment, further comprising engaging the packing screw removal tool with a second wrench by engaging a working feature of the second wrench with a second engagement feature of the torque transfer engagement post, and applying torque by the second wrench to the packing screw removal tool.

A fifteenth embodiment, which is a packing screw removal tool, comprising a tool body having a plate shape that is longer in a first axis of a surface of the tool body than in a second axis of the surface, where the second axis is perpendicular to the first axis, a plurality of packing screw engagement dogs coupled to the tool body, wherein the engagement dogs are distributed about an axis of rotation of the packing screw removal tool and wherein the engagement dogs retain attaching hardware operable to engage in circumferential holes in an outside diameter of a packing screw, and a torque transfer engagement post coupled to the tool body, wherein the post defines a first engagement feature dimensioned to be engaged by a first wrench size and defines a second engagement feature dimensioned to be engaged by a second wrench size.

A sixteenth embodiment, which is the packing screw removal tool of the fifteenth embodiment, wherein the second engagement feature is recessed into the first engagement feature.

A seventeenth embodiment, which is the packing screw removal tool of the fifteenth embodiment, wherein the engagement dogs are aligned with the packing screw to be releasably coupled to the packing screw.

An eighteenth embodiment, which is the packing screw removal tool of the fifteenth embodiment, wherein first engagement feature is a triangular column, a square column, a pentagonal column, a hexagonal column, or an octagonal column.

A nineteenth embodiment, which is the packing screw removal tool of the fifteenth embodiment, wherein the tool body shape allows partial rotation of the packing screw.

A twentieth embodiment, which is the packing screw removal tool of the fifteenth embodiment, wherein a first packing screw engagement dog is located about 60 degrees counterclockwise from a minor axis of the tool body, a second packing screw engagement dog is located about 120 degrees counterclockwise from the minor axis of the tool body, a third packing screw engagement dog is located about 240 degrees counterclockwise from the minor axis of the tool body, and the third packing screw engagement dog is located about 300 degrees counterclockwise from the minor axis of the tool body.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A system for removing a packing screw, comprising:

a wellbore pumping unit comprising at least one packing screw having an axis of rotation, wherein the at least one packing screw is generally a cylindrical shape having an outer end with a plurality of circumferential holes along an outside diameter;

a packing screw removal tool comprising:

a tool body with a plate shape;

a plurality of packing screw engagement dogs coupled to the tool body, wherein the engagement dogs are oriented parallel to an axis of rotation of the at least one packing screw and configured for an allowance fit over an outer end of the packing screw, and wherein the engagement dogs are asymmetrically disposed about the axis of rotation;

a plurality of locking pins releasably coupled to the packing screw engagement dogs, wherein the locking pins are oriented in a radial direction relative to the axis of rotation, and wherein the locking pins are configured to extend or retract in the radial direction to engage or disengage the circumferential holes of the at least one packing screw; and a torque transfer engagement post coupled to the tool body, wherein the torque transfer engagement post extends from the tool body, and wherein the torque transfer engagement post defines a first engagement feature dimensioned to be engaged by a first wrench size.

2. The system of claim 1, wherein the at least one of the packing screw of the wellbore pumping unit comprises a first packing screw adjacent to a second packing screw and wherein the packing screw removal tool is configured to rotate the first packing screw about the axis of rotation of the packing screw prior to removal of the second packing screw.

3. The system of claim 2, wherein the at least one of the packing screw of the wellbore pumping unit further comprises a third packing screw, wherein the second packing screw is positioned between the first and third packing screws, and wherein the packing screw removal tool is configured to rotate the second packing screw prior to removal of the first or third packing screws.

4. The system of claim 1, wherein the wellbore pumping unit is a high pressure oilfield pump comprising at least one plunger or piston.

5. The system of claim 4, wherein the high pressure oilfield pump includes the at least one packing screw and primary packing for the at least one plunger, and wherein the at least one packing screw is configured to retain the primary packing in place.

6. The system of claim 5, wherein the wellbore pumping unit includes a pump power end and a pump fluid end, wherein the pump power end is a fixed distance from the pump fluid end, wherein the at least one packing screw is coupled to the pump fluid end, and wherein the packing screw removal tool is configured to fit between the pump power end and the pump fluid end to releasably couple to one of the at least one packing screw.

7. The system of claim 1, wherein the body comprises a short side and a long side, and wherein at least two packing screw engagement dogs of the plurality of packing screw engagement dogs are located on the short side of the body of the packing screw removal tool.

8. The system of claim 7, wherein the at least two packing screw engagement dogs are configured to align with the circumferential holes along an outside diameter of the at least one packing screw.

9. The system of claim 8, wherein the plurality of packing screw engagement dogs further comprise at least three packing screw engagement dogs located on an opposite short side of the packing screw removal tool and configured to align with the circumferential holes along the outside diameter of the packing screw.

* * * * *